US012203280B2

(12) United States Patent
Burrow

(10) Patent No.: US 12,203,280 B2
(45) Date of Patent: Jan. 21, 2025

(54) TEMPORARY STEP AND SUPPORT

(71) Applicant: Matthew Burrow, Taylors, SC (US)

(72) Inventor: Matthew Burrow, Taylors, SC (US)

( * ) Notice: Subject to any disclaimer, the term of this patent is extended or adjusted under 35 U.S.C. 154(b) by 629 days.

(21) Appl. No.: 17/120,987

(22) Filed: Dec. 14, 2020

(65) Prior Publication Data

US 2021/0131128 A1 May 6, 2021

Related U.S. Application Data

(62) Division of application No. 16/124,248, filed on Sep. 7, 2018.

(51) Int. Cl.
*E04G 27/00* (2006.01)

(52) U.S. Cl.
CPC ..... *E04G 27/00* (2013.01)

(58) Field of Classification Search
CPC .. E04G 27/00; E04G 5/10; E04G 9/04; A63B 27/00; A63B 27/02; A63B 27/04
USPC ..... 182/92
See application file for complete search history.

(56) References Cited

U.S. PATENT DOCUMENTS 141,498 A * 8/1873 Edmonston ..... A47B 57/56 248/217.1
175,407 A * 3/1876 Beaumont, Jr. ..... A63B 25/00 482/76
459,844 A * 9/1891 Thomas ..... E06C 9/04 144/287
623,517 A * 4/1899 Carpenter ..... A47B 57/56 182/189
1,185,404 A * 5/1916 Hughes et al. ..... A01M 31/02 182/187
1,206,574 A * 11/1916 Miller ..... A01M 31/02 248/230.8
1,247,622 A * 11/1917 Berrigan ..... E05C 19/18 292/288
1,597,095 A * 8/1926 Martinsen ..... E04G 5/061 248/210
2,086,280 A * 7/1937 Matter ..... A47B 57/56 482/76
2,592,057 A * 4/1952 Murphey ..... E04G 5/06 248/235
2,605,074 A * 7/1952 Bucsko ..... E04G 5/06 248/228.2

(Continued)

*Primary Examiner* — Colleen M Chavchavadze
*Assistant Examiner* — Shiref M Mekhaeil
(74) *Attorney, Agent, or Firm* — Southeast IP Group LLC; Thomas L. Moses

(57) ABSTRACT

A temporary step and support assembly includes two primary portions: an attachment member and a horizontal surface member. The attachment member preferably includes three sides for engaging a board or other fixed support, wherein the first side and the third side are disposed in parallel relation, and the second side is preferably angled upwardly from the first side to the third side. The horizontal support member, extends from the first side of the attachment member, and serves as a temporary step, so that a user may attach the temporary step and support assembly to a board or other fixed support for standing or climbing to reach a greater height in an upward direction. Optionally, the horizontal support member may be angularly adjustable with respect to the attachment member for use on angled fixed support studs, boards or framing.

7 Claims, 9 Drawing Sheets

(56) References Cited

U.S. PATENT DOCUMENTS 2,774,562 A * 12/1956 Henry ..... A47G 7/044 248/315
2,833,503 A * 5/1958 Harshbarger ..... E04G 5/06 182/113
2,842,300 A * 7/1958 Johnson ..... A63B 27/00 182/133
2,883,134 A * 4/1959 O'Halloran ..... E06C 7/14 248/210
3,004,622 A * 10/1961 Ringer ..... A63B 27/02 182/134
3,148,857 A * 9/1964 Hutchison ..... E04G 5/062 182/187
3,298,459 A 1/1967 Bergsten
3,561,563 A * 2/1971 Harsh ..... E06C 9/04 D30/158
3,595,510 A * 7/1971 Hutchinson ..... E04G 5/06 182/113
3,698,680 A * 10/1972 Shoemaker ..... E04G 17/002 249/189
4,161,233 A * 7/1979 Wirtz ..... A01M 31/02 108/2
4,167,255 A * 9/1979 Benson ..... B65H 49/327 242/129
4,368,800 A * 1/1983 Campbell ..... E04G 1/15 248/217.1
4,427,092 A * 1/1984 Tentler ..... A63B 27/02 248/218.4
4,574,919 A * 3/1986 Clay ..... A63B 27/02 182/221
4,605,098 A * 8/1986 Leuty ..... B60R 3/007 182/92
4,620,609 A * 11/1986 Elsten ..... B60R 3/007 182/92
4,669,575 A * 6/1987 Skyba ..... A63B 27/00 248/217.4
4,696,372 A * 9/1987 Fields ..... E04G 21/26 182/120
4,697,669 A * 10/1987 Bergsten ..... E06C 9/04 182/189
4,754,841 A * 7/1988 Koffski ..... E06C 9/04 248/217.1
4,817,899 A * 4/1989 Clarke ..... A01K 39/00 248/218.4
4,969,620 A * 11/1990 Plummer ..... E06C 1/381 248/246
4,997,063 A * 3/1991 Bradley ..... A45F 3/26 182/136
5,020,757 A * 6/1991 Sulecki ..... E04G 5/065 248/500
5,259,477 A * 11/1993 Fears ..... E04G 5/06 182/113
D342,200 S * 12/1993 Hass ..... D8/71
5,285,868 A * 2/1994 Amacker ..... A01M 31/02 182/187
5,535,974 A * 7/1996 Savitski ..... E04G 5/06 248/246
5,806,628 A * 9/1998 Fullam ..... E04G 21/3276 182/135
5,845,743 A * 12/1998 Dechant ..... E04G 5/06 248/246
5,865,410 A * 2/1999 Horen ..... E04G 5/06 248/240.4
5,927,437 A * 7/1999 Fast ..... A01M 31/02 182/187
5,941,486 A * 8/1999 Riblet ..... E04G 5/061 248/248
6,126,127 A * 10/2000 Riblet ..... A47B 96/061 248/248
6,367,585 B1 * 4/2002 Fast ..... A01M 31/02 182/135
6,752,243 B1 * 6/2004 Terzini ..... E04G 5/062 182/189
7,032,268 B2 * 4/2006 Jackson ..... E01D 21/00 248/242
7,258,197 B1 * 8/2007 Wicks ..... E04G 5/06 248/246
7,341,229 B1 * 3/2008 Flowers ..... B65H 49/325 248/301
7,823,852 B1 * 11/2010 Reno ..... A47G 7/044 248/302
8,522,920 B1 * 9/2013 Salyer ..... A01M 31/02 182/187
D696,821 S * 12/2013 Haaf ..... D30/160
9,089,125 B1 * 7/2015 Fast ..... A01M 31/02
9,409,055 B1 * 8/2016 Niemela ..... A63B 27/00
9,516,874 B2 * 12/2016 Richey ..... A01M 31/02
10,524,577 B2 * 1/2020 Christie ..... A47C 5/10
10,876,306 B2 * 12/2020 Jackson ..... E01D 21/00
11,229,199 B2 * 1/2022 Gibbens ..... A01M 31/02
2004/0129496 A1 * 7/2004 Clark ..... A63B 27/00 182/92
2005/0006174 A1 * 1/2005 Terzini ..... E06C 9/04 182/92
2009/0218165 A1 * 9/2009 Maurer ..... A63B 27/04 182/112
2015/0053503 A1 * 2/2015 Richey ..... E04G 5/067 182/187

* cited by examiner

TEMPORARY STEP AND SUPPORT

This application is a divisional application of U.S. patent application Ser. No. 16/124,248, filed on Sep. 7, 2018, which is hereby incorporated herein by reference, in its entirety.

BACKGROUND OF THE INVENTION

The present invention generally relates to devices that may be attached to boards, studs, support beams to be used as a temporary step or support member. More specifically, the present invention includes a three sided, rigid structure for attachment to a support structure that includes a horizontal surface for use as a step, or for use as a support mechanism.

In the construction industry, it is often necessary for a worker to work at a height that may be out of reach while the worker is standing on a floor or on ground level. Traditionally, a worker may employ a step stool, a ladder, scaffolding, or the like, in order to reach the area where such work is required. However, ladders are heavy and cumbersome, take up a lot of space, and have caused countless accidents. Step stools are smaller and easier to use, but they are frequently of little value because of their limited height. Scaffolding is heavy, expensive and time consuming to erect, and occupies an enormous amount of space.

Therefore, it would be desirable to provide a small, lightweight structure that may be temporarily attached to framing in a house or building, such as a two by four stud, or the like, which is easy to install and remove, and which is not heavy, expensive or cumbersome. Efforts to develop such a structure or system have been attempted with varying degrees of success.

For example, the following references disclose several types of such devices, and each of the references below is hereby incorporated by reference herein, in their entireties.

U.S. Pat. No. 3,298,459 Tree Climbing Apparatus

This invention relates to apparatus for facilitating the climbing of trees and more particularly to tree climbing steps of the removable type particularly adapted for the use by sportsmen.

U.S. Pat. No. 4,696,372 Portable Step and Carrying Device for Stud Wall

A portable step-forming device releasably attachable to a vertical wooden stud comprises a U-shaped gripping member for closely receiving a stud member, a step member attached to one prong of the U-shaped member and further having an enlarged end for retaining the user's foot on the step member, and a gripping means comprising a spring-loaded reciprocable member with a stud-engaging end for holding the step-forming device in position of the stud member.

U.S. Pat. No. 3,561,563 Portable Post Step

An integral rigid catwalk metal sheet bent along a transverse fold line to provide a post engaging portion and a step portion, the post engaging portion having a laterally inwardly extending notch for engaging the post. The post is engaged by opposing edges of the notch wherein one of the edges is the inner edge portion of the step portion. The step is placed on the post from the side and the weight of the step portion will cause the unit to pivot downwardly bringing the opposing edges of the notch into engagement with the post thereby locking it in place. The post engaging portion forms an obtuse angle with the step portion and the step portion is normally positioned in a horizontal plane. A series of vertically spaced apart steps may be placed on a post and extend alternately from the post at angles of 90* to each other.

Oppositely facing concave portions may be formed in the opposing edge portions for matingly engaging the rounded peripheral edge of a round post.

BRIEF SUMMARY OF THE INVENTION

In accordance with one aspect of the invention, a first embodiment of a temporary step and support assembly includes two primary portions: an attachment member and a horizontal support surface. The attachment member preferably includes three sides for engaging a board or vertical support, wherein the first side and the third side are disposed in parallel relation, and the second side is preferably angled upwardly from the first side to the third side. The horizontal support surface, in a preferred embodiment, is attached to the first side of the attachment member, and serves as a temporary step, so that a user may attach the temporary step and support assembly to a vertical board for standing or climbing to reach a greater height in an upward direction.

The temporary step and support assembly may be attached to the board or support member in any suitable manner. In one embodiment, the first side of the attachment member may define a threaded opening for receiving a screw or bolt. Optionally, the third side of the attachment member may also define such a hole for receiving a screw or bolt. Alternatively (or along with other attachment means), one or more spikes or teeth may project from the first side and/or third side of the attachment member to temporarily secure the temporary step and support assembly to the vertical support.

A series of temporary step and support assemblies may be attached to one or more boards or supports in order to provide a temporary ladder or a series of steps for a user to climb in lieu of a ladder, scaffolding, or a step stool. It should be understood that the device may be used not only for a step, but for other tasks, such as a support for tools, a place to hang a tool bag, or for any other desired purpose.

BRIEF DESCRIPTION OF THE DRAWINGS

These and other features, aspects, and advantages of the present invention will become better understood with regard to the following description, appended claims, and accompanying drawings where:

DETAILED DESCRIPTION OF THE INVENTION

Figure 1:
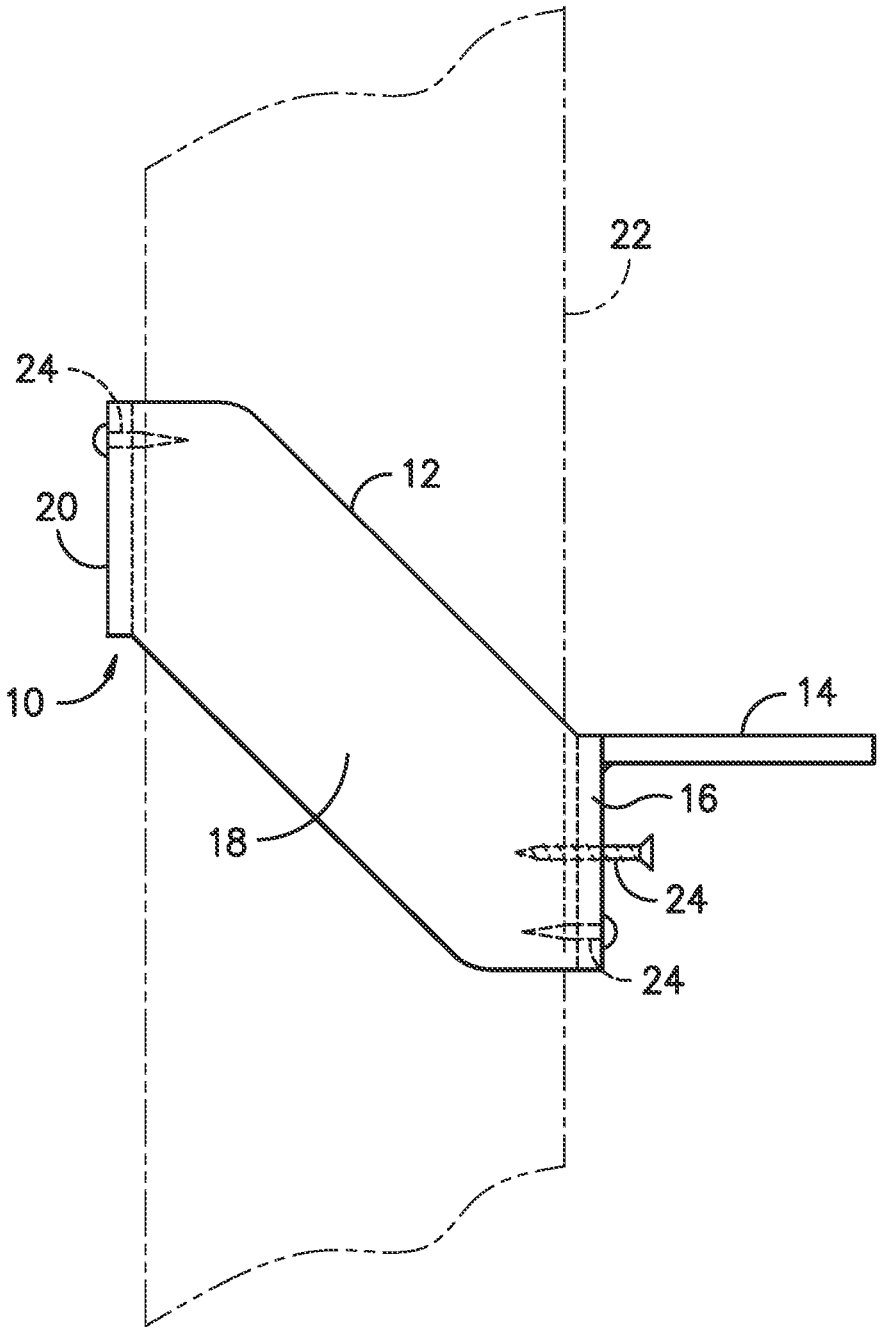
FIG. 1 is a side view of one embodiment of the present invention, showing a temporary step and support assembly attached to a vertically oriented board.
Figure 2:
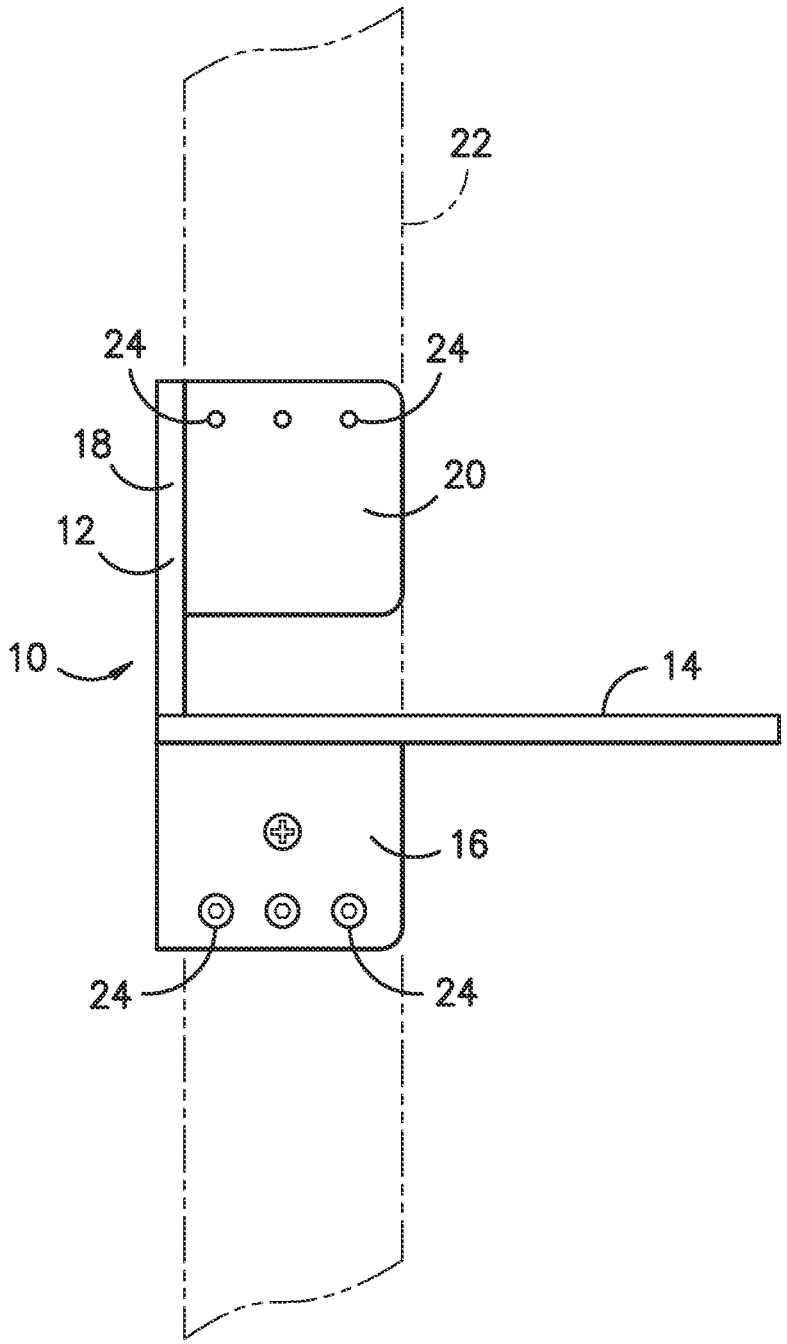
FIG. 2 is a cutaway view of one embodiment of the present invention, showing a temporary step and support assembly attached to a vertically oriented board.
Figure 3:
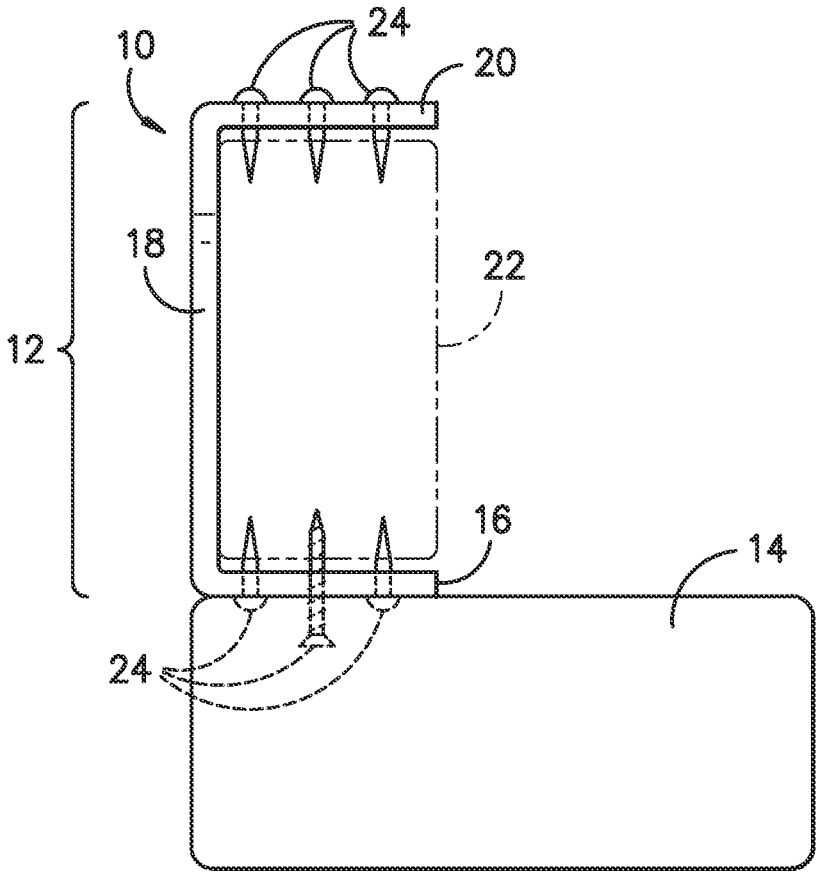
FIG. 3 is a cross-sectional top view of one embodiment of the present invention, showing a temporary step and support assembly attached to a vertically oriented board.

The present invention, in a first embodiment, includes a temporary step and support assembly 10 having two primary portions: an attachment member 12 and a horizontal support surface (or horizontal surface member) 14. The attachment member preferably includes three sides for engaging a board or vertical support 22 (such as a framing stud in home construction), wherein the first side 16 and the third side 20 are disposed in offset parallel relation to one another on opposite sides of a vertical support member 22, and the second side 18 is preferably angled upwardly from the first side 16 to the third side 20, as shown in FIGS. 1-4. The horizontal support surface 14, in a preferred embodiment, is attached to the first side 16 of the attachment member 12, and serves as a temporary step, so that a user may attach the temporary step and support assembly 10 to a vertical board 22 for standing or climbing to reach a greater height in an upward direction.

Optionally, attachment means 24 may be provided, in order to temporarily secure the step and support assembly 10 to a vertical support member 22, such as a 2 inch by 4 inch (hereinafter "2×4") board or stud. Attachment means 24 may include screws that extend through holes in the first and/or third sides of the attachment member 12 and into the vertical board 22, or the attachment means 24 may be protruding teeth, spikes, bolts, nails, or any other suitable means for temporarily securing the attachment member 12 to the vertical board 22. If protruding teeth or spikes are used, they may be disposed perpendicularly or at an angle with respect to the planes of the first and/or third sides 16, 18 of the attachment member 12.

Figure 4:
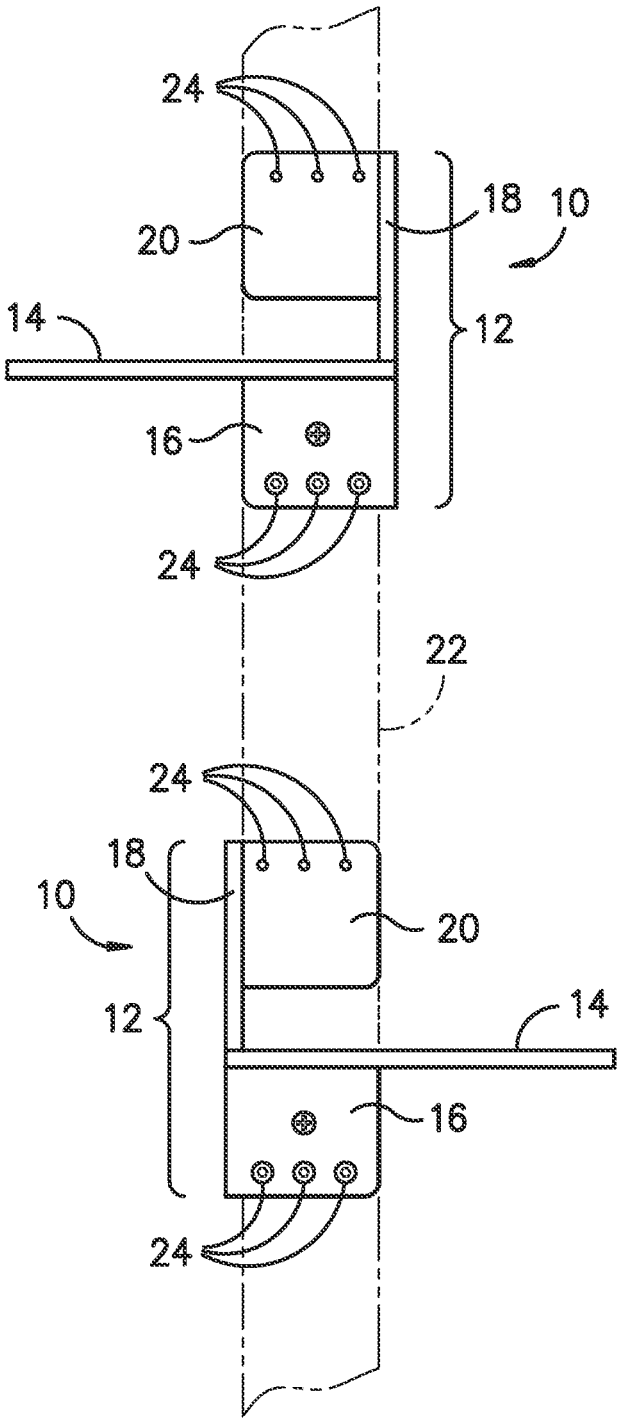
FIG. 4 is a cutaway front view of one embodiment of the present invention, showing two temporary step and support assemblies attached to a vertically oriented board.
Figure 5:
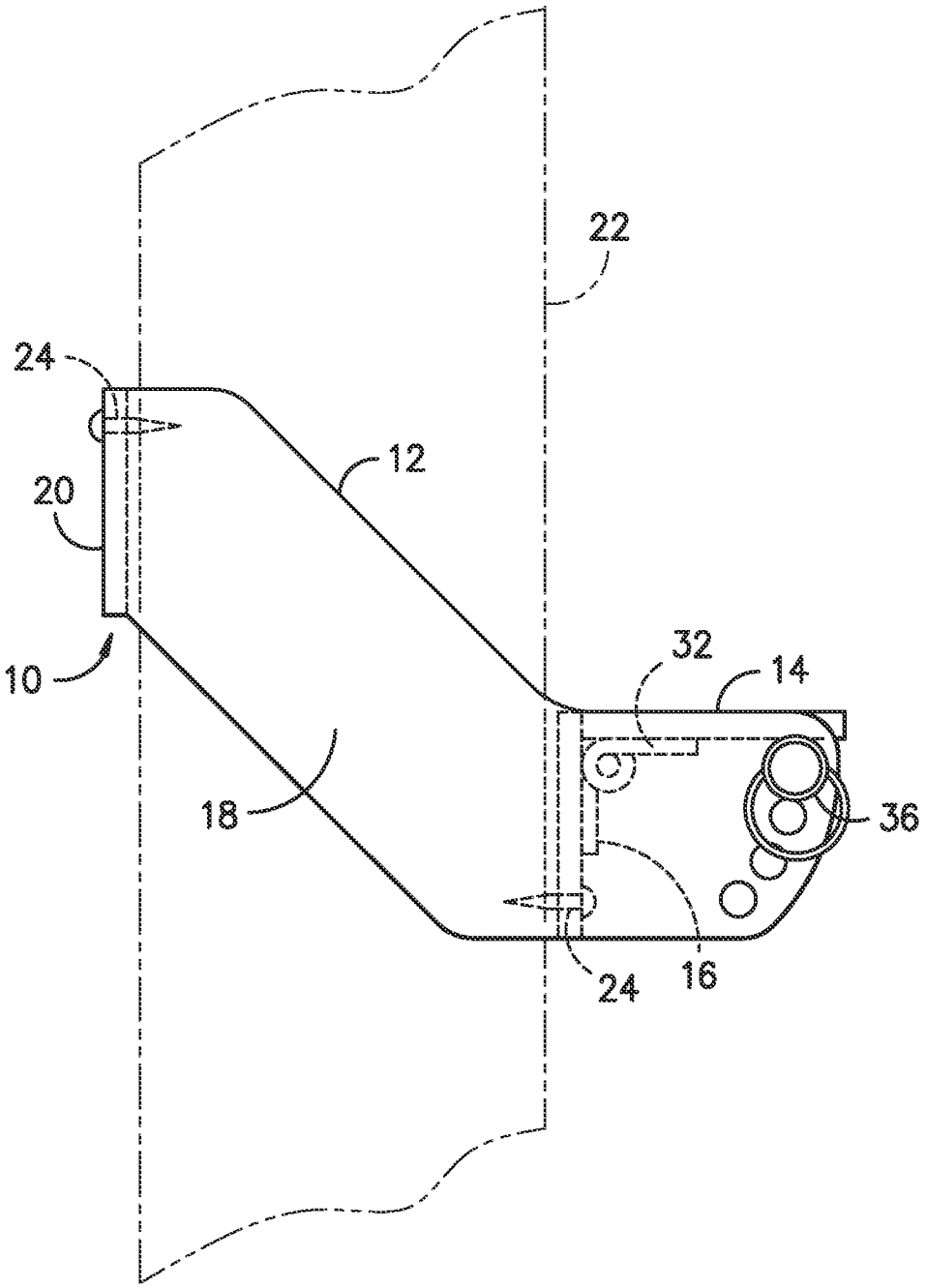
FIG. 5 is a cutaway side view of another embodiment of the present invention, showing a temporary step and support assembly having the horizontal surface member pivotally attached to the attachment member via a hinge, and wherein the second side extends beyond the edge of the first side and includes a series of holes for receiving a securing pin mechanism for holding the horizontal surface member in a generally horizontal orientation.
Figure 6:
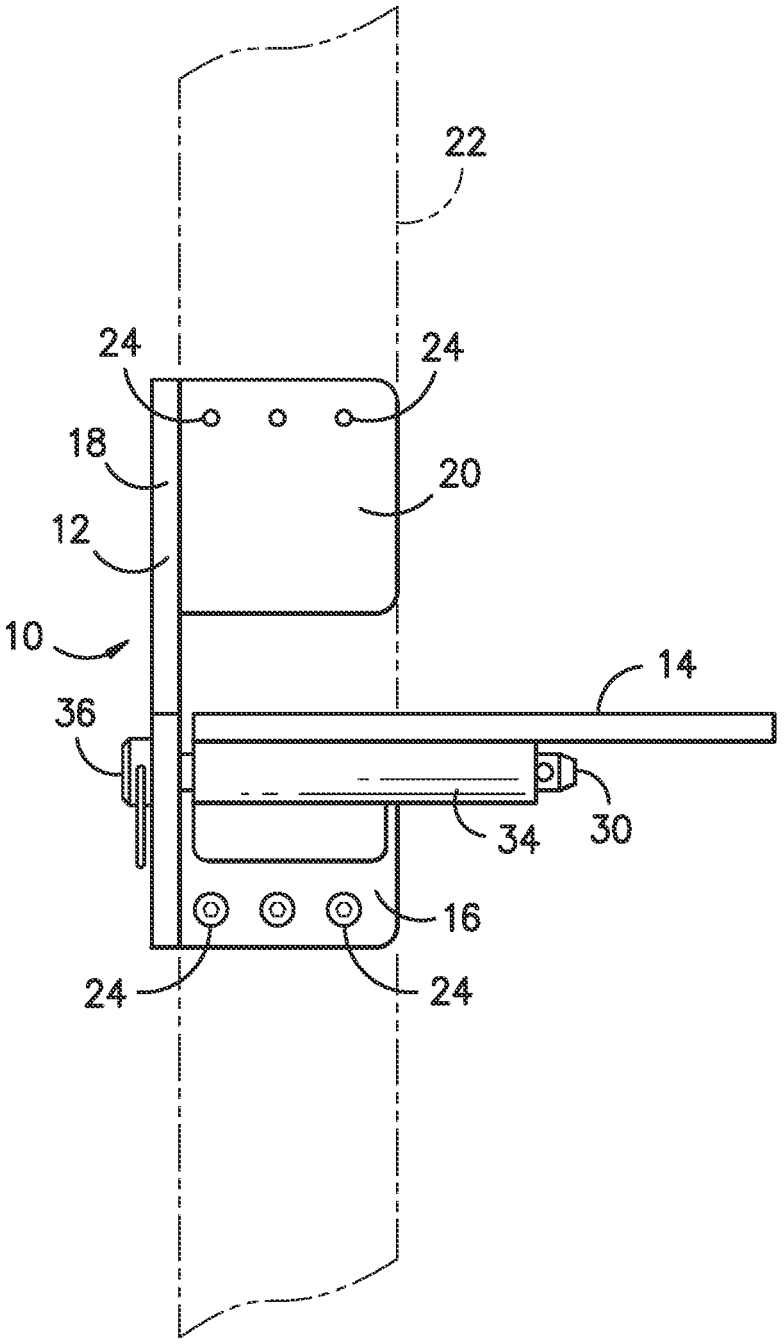
FIG. 6 is a cutaway front view of the embodiment shown in FIG. 5 showing a temporary step and support assembly having the horizontal surface member pivotally attached to the attachment member via a hinge, and wherein the second side extends beyond the edge of the first side and includes a series of holes for receiving a securing pin mechanism for holding the horizontal surface member in a generally horizontal orientation.
Figure 7:
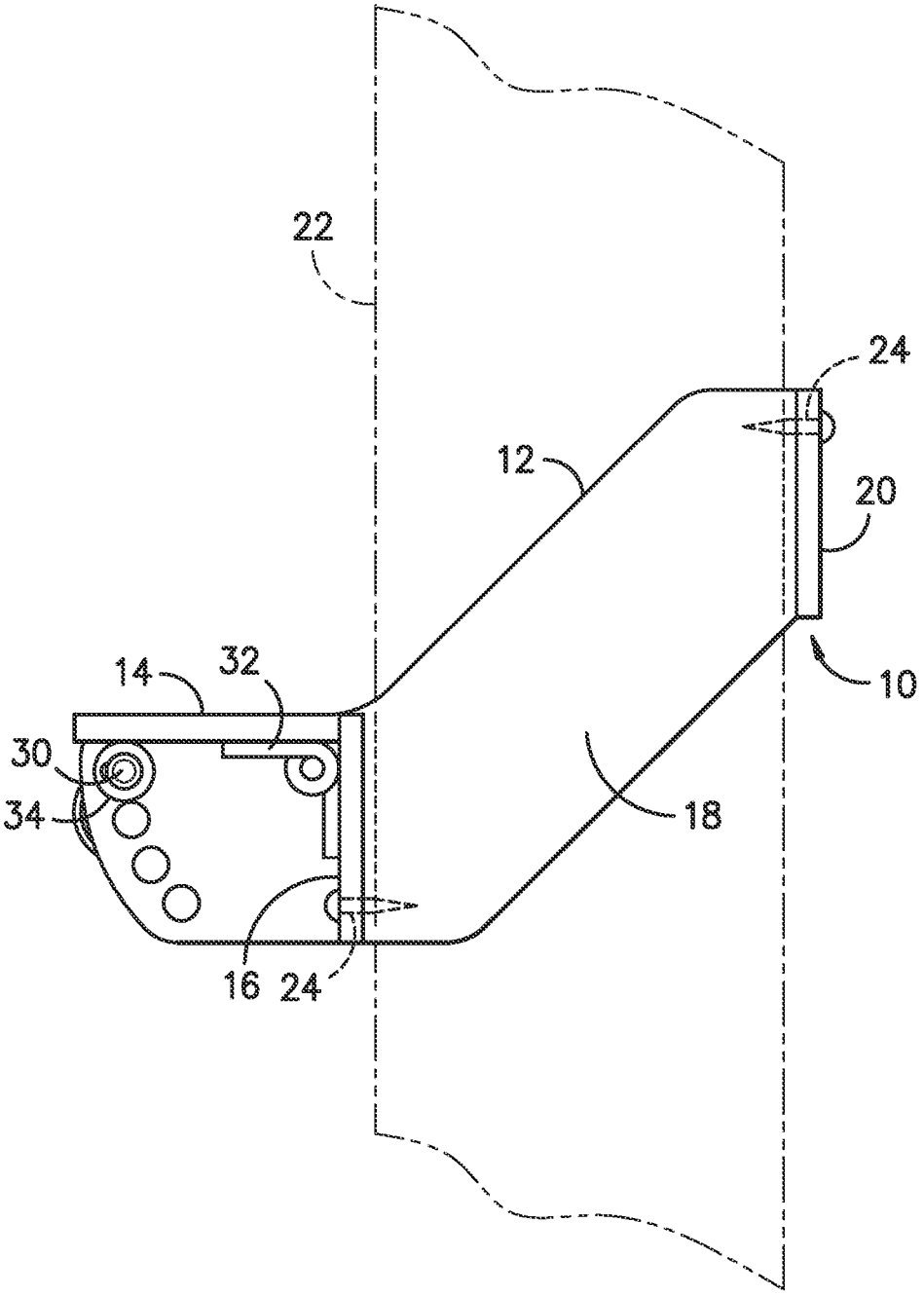
FIG. 7 is a cutaway side view of the embodiment shown in FIG. 5 showing a temporary step and support assembly having the horizontal surface member pivotally attached to the attachment member via a hinge, and wherein the second side extends beyond the edge of the first side and includes a series of holes for receiving a securing pin mechanism for holding the horizontal surface member in a generally horizontal orientation.
Figure 8:
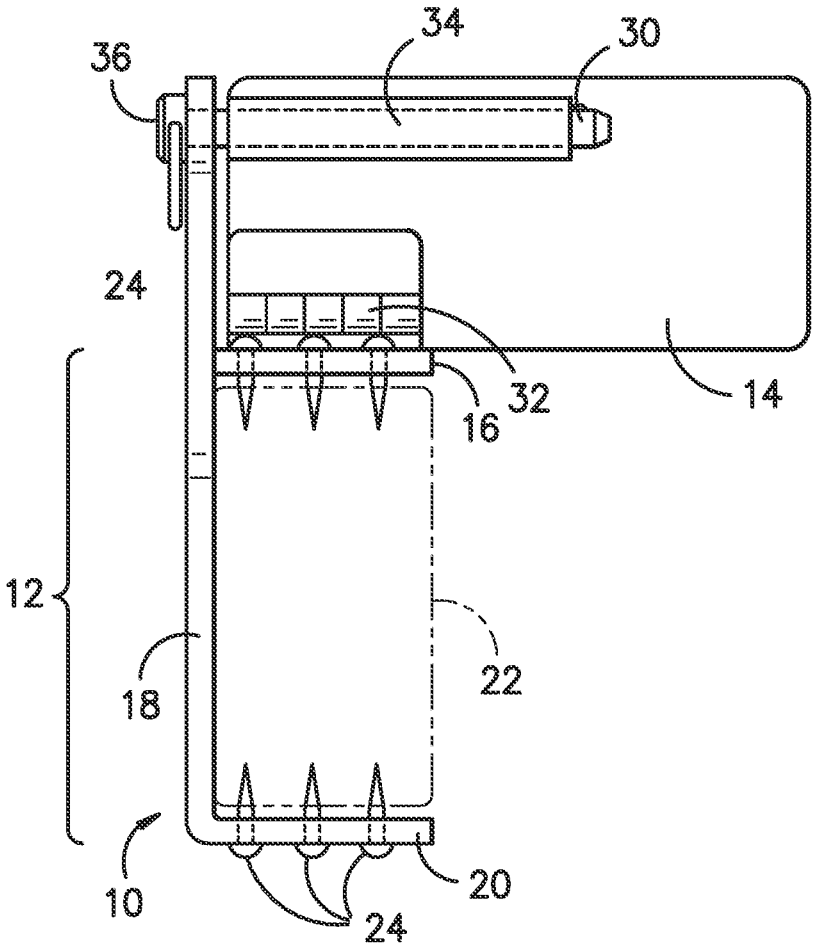
FIG. 8 is a cutaway top view of the embodiment shown in FIG. 5 showing a temporary step and support assembly having the horizontal surface member pivotally attached to the attachment member via a hinge, and wherein the second side extends beyond the edge of the first side and includes a series of holes for receiving a securing pin mechanism for holding the horizontal surface member in a generally horizontal orientation.
Figure 9:
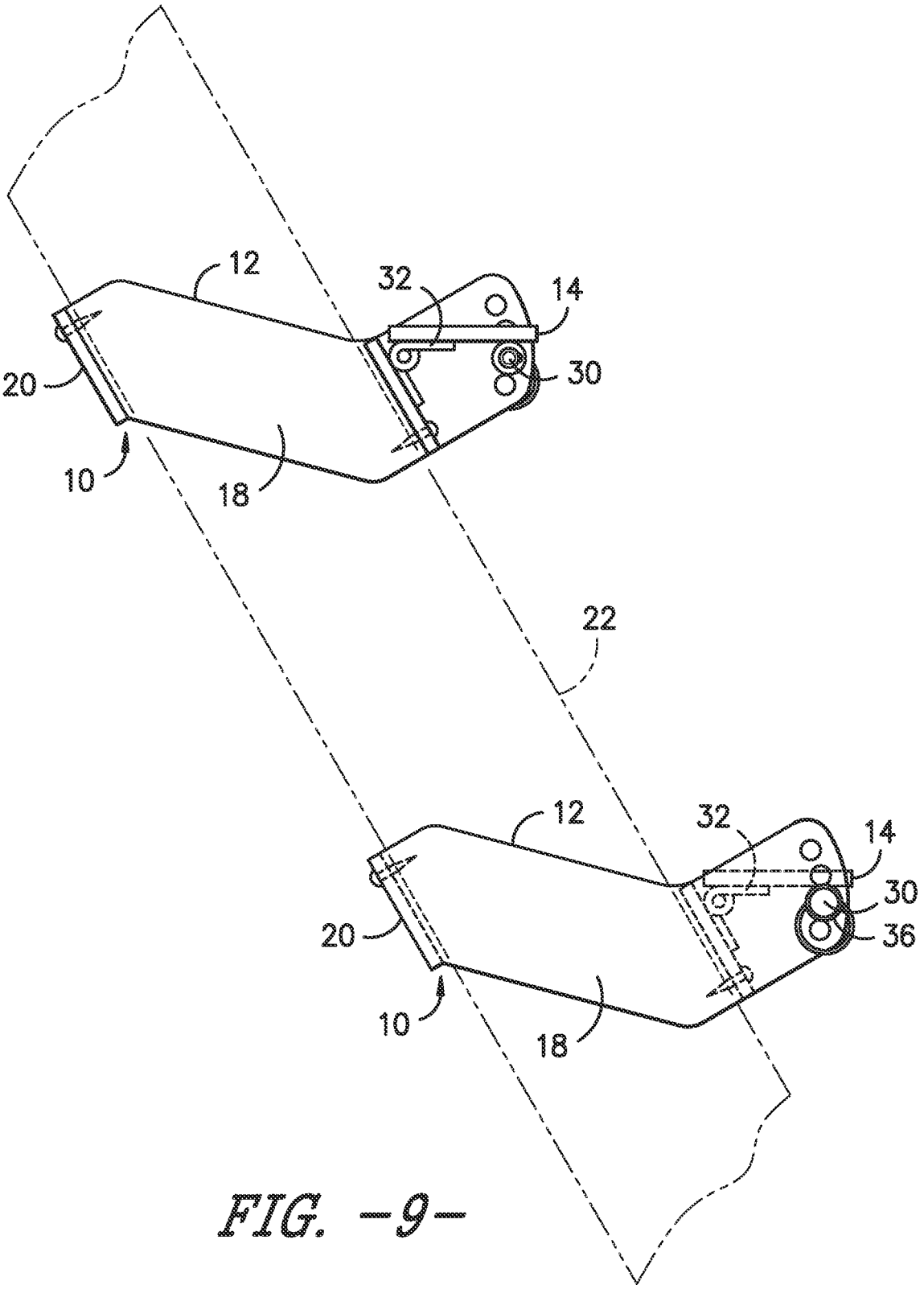
FIG. 9 is a cutaway side view of one embodiment of the present invention, showing two temporary step and support assemblies with angularly adjustable horizontal surface member attached to an angularly oriented fixed support.

A series of step and support members 10 may be attached to vertical boards 22, in order to provide multiple steps, so that a user may climb upwardly on a house framing job, for instance, as shown in FIG. 4. The step and support assemblies 10 may be attached to the same board 22, or to different boards, as desired, to form a ladder, of sorts. This arrangement can be used instead of a ladder, step stool, or scaffolding, and is smaller, lighter, and occupies much less space than these alternatives.

In another embodiment, the step and support assembly 10 may be designed to be affixed to a stud or section of framing that is not vertically oriented, but rather, is oriented at an angle other than a vertical orientation. In this embodiment, the horizontal surface member extends angularly from the attachment member so that when the attachment member is affixed to a board in an angular orientation (45 degrees, for instance), then the step member is disposed in a generally horizontal orientation, as shown in Fig. __.

Optionally, the horizontal support surface 14 may be pivotally attached to the attachment member 12 to provide for an angular adjustment of the horizontal support surface 14, so that a user can attach the attachment member 12 to a board in an angular configuration (in other words, the board is not vertically oriented), and the user may then pivotally adjust the horizontal support surface 14 and secure it in a horizontal orientation. In this embodiment, as shown in FIGS. 5-9, the second side 18 of the attachment member extends beyond the edge of the first side 16 thereof, and includes a series of holes for receiving securing pins 30 or other securing means. The horizontal surface member 14 is affixed to the attachment member via a hinge 32, so that the horizontal surface member may be pivoted and adjusted to a generally horizontal position, and then secured in that generally horizontal position by inserting a pin into the appropriate hole beneath the step member. The securing pin 30 may include a head 36 on one side thereof, and a pin sleeve 34 that snap fits onto an opposed side of the pin 30 in order to temporarily secure the pin 30 within the desired hole.

Optionally, the pin and holes may be threaded, so that the pin is screwed into the hole to secure the pin in place beneath the horizontal surface member for support. Other securing mechanisms or components may be used to temporarily support the horizontal surface member in a generally horizontal orientation, including bolts through the holes, snap-fit mechanisms, or other similar devices that are commonly used for such purposes and are well-known in the art.

The temporary step and support assembly 10 is preferably rigid, made from any suitable metal, high grade plastic or the like, and may be integrally formed or may be formed of multiple pieces and assembled. Although the function of the step and support assembly 10 has been described herein primarily as a step, it should be understood that the device 10 may also be used to support any desired item, including tools, tool bags, equipment, or any other item.

Although the present invention has been described in considerable detail with reference to certain preferred versions thereof, other versions are possible. Therefore, the spirit and scope of the appended claims should not be limited to the description of the preferred versions contained herein. All features disclosed in this specification may be replaced by alternative features serving the same, equivalent or similar purpose, unless expressly stated otherwise. Thus, unless expressly stated otherwise, each feature disclosed is one example only of a generic series of equivalent or similar features.

The invention claimed is:

1. A step and support device comprising:

an attachment member having a first side, a second side and a third side for engaging a fixed support, wherein said first side and said third side are oriented in parallel planes, and wherein said second side is oriented in a plane that is perpendicular to said first side and said third side; wherein said first and third sides are configured to attach to opposite sides of the fixed support, and wherein, said first side, said second side and said third side are each configured to directly engage the fixed support;

a horizontal surface member adjustably attached to and projecting outwardly from said attachment member so that said horizontal surface member is in a generally horizontal orientation when said step and support device is attached to the fixed support;

wherein said horizontal surface member is pivotally attached to said attachment member so that said attachment member may is configured to be attached to said fixed support, said horizontal surface member is pivotable about a horizontal axis, and said horizontal surface member is angularly adjustable and configured to be secured in said generally horizontal orientation; and wherein said second side defines a plurality of holes for receiving a pin for supporting said horizontal surface member in said generally horizontal orientation; and said pin temporarily extends through one of said plurality of holes on said second side of said attachment member to support said horizontal surface member in said generally horizontal orientation, wherein said pin is removable therefrom.

2. The step and support device set forth in claim 1, further including attachment means for removably securing said device to said fixed support.

3. The step and support device set forth in claim 2, wherein said attachment means is selected from the group consisting of a screw, bolt, spike and a nail.

4. The step and support device set forth in claim 3, wherein said attachment means is positioned on said first side.

5. The step and support device set forth in claim 3, wherein said attachment means is positioned on said third side.

6. The step and support device set forth in claim 3, wherein said attachment means is positioned on said first side, and a second attachment means is positioned on said third side.

7. The step and support device set forth in claim 1, further including a hinge member attached between said attachment member and said horizontal surface member so that said horizontal surface member may be angularly adjusted with respect to said attachment member.

* * * * *